US006944904B1

(12) United States Patent
Williams

(10) Patent No.: US 6,944,904 B1
(45) Date of Patent: Sep. 20, 2005

(54) CHALKBOARD CLEANING APPARATUS WITH A FLUID RESERVOIR

(76) Inventor: Gaylord A Williams, 25 Audrey Ave., Mt. Vernon, NY (US) 10553

( * ) Notice: Subject to any disclaimer, the term of this patent is extended or adjusted under 35 U.S.C. 154(b) by 14 days.

(21) Appl. No.: 10/638,793

(22) Filed: Aug. 11, 2003

(51) Int. Cl.[7] ..... B43L 21/00; B43L 21/02

(52) U.S. Cl. ..... 15/246; 15/97.1; 15/98; 434/417; 401/139; 401/188 R; 401/193

(58) Field of Search ..... 15/97.1, 246, 98, 15/102, 103, 250.29, 250.11; 434/417; 401/171, 401/176, 177, 196, 261, 188 R, 193, 137, 401/139

(56) References Cited

U.S. PATENT DOCUMENTS 1,545,961 A * 7/1925 Keenan ..... 401/206
1,829,396 A * 10/1931 Gray ..... 15/250.01
2,167,296 A * 7/1939 Farmer ..... 15/98
3,163,943 A * 1/1965 Bell ..... 434/417
3,731,335 A * 5/1973 Chrisp ..... 15/97.1
3,858,265 A * 1/1975 Schlick ..... 15/77
5,319,820 A * 6/1994 Forst ..... 15/98
5,649,828 A * 7/1997 Kawashima ..... 434/411

* cited by examiner

*Primary Examiner*—Gary K. Graham
(74) *Attorney, Agent, or Firm*—Michael I Kroll

(57) ABSTRACT

The present invention 10 discloses a chalkboard cleaning device that is mountable to a conventional chalkboard 12 providing means for selectively cleaning parts thereof. The present invention 10 is comprised of a rail 18 mounted to the top edge of an existing chalkboard 12 having the cleaning apparatus 20 attached thereto and extending from the top to the bottom edge of the board 12. The present invention 10 is comprised of an adjustable frame 30 and sponge 20 which is trimmed at the time of installation to fit the adjusted frame size. The frame 30 has a tensioned 40 rail 18 engaging element 27 for selectively moving the cleaning apparatus 20 to a desired point to be cleaned. Once positioned the apparatus 10 has a pump 26 and fluid containing reservoir 22 in communication with sponge 20 whereby pressure applied to the pump button 48 releases fluid 54 into the body of the sponge 20 whereupon movement of the cleaning apparatus by means of the handle 24 cleans the selected area. The fluid reservoir 22 has a cap 34 for refilling the reservoir on site or the reservoir can be dismounted for refilling and remounted. Additionally, the present invention 10 provides for an alternate pump mechanism 26 wherein the fluid spray 54 is applied to the chalkboard 12 adjacent the sponge 20.

13 Claims, 10 Drawing Sheets

CHALKBOARD CLEANING APPARATUS WITH A FLUID RESERVOIR

BACKGROUND OF THE INVENTION

1. Field of the Invention

The present invention relates generally to cleaning devices and, more specifically, to a chalkboard cleaning device that is mountable to a conventional chalkboard providing means for selectively cleaning parts thereof. The device is comprised of a rail mounted to the top periphery edge of an existing chalkboard having the cleaning apparatus attached thereto and extending from the top to bottom edge of the board. The device is comprised of an adjustable frame and sponge which is trimmed at the time of installation to fit the adjusted frame size. The frame has a tensioned rail engaging element for selectively moving the cleaning apparatus to a desired point to be cleaned. Once positioned the cleaning apparatus has a pump and fluid containing reservoir in communication with the aforementioned sponge whereby pressure applied to the pump button releases fluid into the body of the sponge whereupon movement of the cleaning apparatus by means of the handle cleans the selected area. The fluid reservoir has a cap for refilling the reservoir on site or the reservoir can be dismounted for refilling and remounted.

Additionally, the present invention provides for an alternate pump mechanism wherein the fluid spray is applied to the chalkboard adjacent the sponge.

2. Description of the Prior Art

There are other cleaning devices that can be used for cleaning and while these devices may be suitable for the purposes for which they were designed, they would not be as suitable for the purposes of the present invention, as hereinafter described.

Therefore it is felt that a need exist for a cleaning device that can effectively clean a chalkboard in a single swipe removing all of the chalk dust therefrom.

SUMMARY OF THE PRESENT INVENTION

The present invention discloses a chalkboard cleaning device that is mountable to a conventional chalkboard providing means for selectively cleaning parts thereof. The present invention is comprised of a rail mounted to the top edge of an existing chalkboard having the cleaning apparatus attached thereto and extending from the top to the bottom edge of the board. The present invention is comprised of an adjustable frame and sponge which is trimmed at the time of installation to fit the adjusted frame size. The frame has a tensioned rail engaging element for selectively moving the cleaning apparatus to a desired point to be cleaned. Once positioned the cleaning apparatus has a pump and fluid containing reservoir in communication with the aforementioned sponge whereby pressure applied to the pump button releases fluid into the body of the sponge whereupon movement of the cleaning apparatus by means of the handle cleans the selected area. The fluid reservoir has a cap for refilling the reservoir on site or the reservoir can be dismounted for refilling and remounted. Additionally, the present invention provides for an alternate pump mechanism wherein the fluid spray is applied to the chalkboard adjacent the sponge.

A primary object of the present invention is to provide a cleaning device that will remove chalk from a chalkboard in an efficient manner.

Another object of the present invention is to provide a cleaning device that will leave the chalkboard in a pristine condition without erasure marks after being cleaned.

Yet another object of the present invention is to provide a cleaning device that will remove all residual chalk dust from the board during a cleaning session.

Still yet another object of the present invention is to provide a cleaning device that will reduce the time necessary to clean a chalkboard.

A further object of the present invention is to provide a cleaning device that is easy to use.

A yet further object of the present invention is to provide a cleaning device that absorbs the chalk dust during the cleaning process.

A still yet further object of the present invention is to provide a cleaning device having a rail mounted to the top periphery edge of a chalkboard.

Another object of the present invention is to provide a cleaning device having a rail engaging member whereby said device can be moved along said rail.

Yet another object of the present invention is to provide a tensioning member engaging said rail engaging member whereby said cleaning device is spaced away from said chalkboard for selectively positioning for a cleaning application.

Still yet another object of the present invention is to provide a cleaning device having a frame mounted to said rail engaging member.

A further object of the present invention is to provide a sponge residing in said frame.

A yet further object of the present invention is to provide a frame that is length adjustable.

A still yet further object of the present invention is to provide a sponge that can be trimmed to fit the adjusted frame size.

Another object of the present invention is to provide a fluid reservoir that is mountable to said frame.

Yet another object of the present invention is to provide said frame with means for retaining said fluid reservoir.

Still yet another object of the present invention is to provide said fluid reservoir with a cap for refilling said reservoir.

A further object of the present invention is to provide a manual pump for moving the fluid from the reservoir to the sponge.

A yet further object of the present invention is to provide a frame having a plurality of channels and apertures for applying the reservoir fluid to the sponge.

A still yet further object of the present invention is to provide alternate channels within said frame for applying the reservoir fluid to the chalkboard.

Another object of the present invention is to provide a handle to said cleaning device for easily moving said device during a cleaning application. Additional objects of the present invention will appear as the description proceeds.

The present invention overcomes the shortcomings of the prior art by providing a cleaning device for a chalkboard that is mountable to a conventional chalkboard providing means for selectively cleaning parts thereof. Comprising a rail mounted to the top edge of a chalkboard with the cleaning apparatus attached thereto extending from the top to bottom edge of the board. The device being comprised of an adjustable frame and sponge wherein said frame has a tensioned rail engaging element for selective positioning of the cleaning apparatus for a cleaning application and wherein said device has a pump and fluid containing reservoir in communication with the sponge whereby fluid can be selectively applied into the body of said sponge whereby movement of the cleaning apparatus by means of the handle cleans the selected area.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
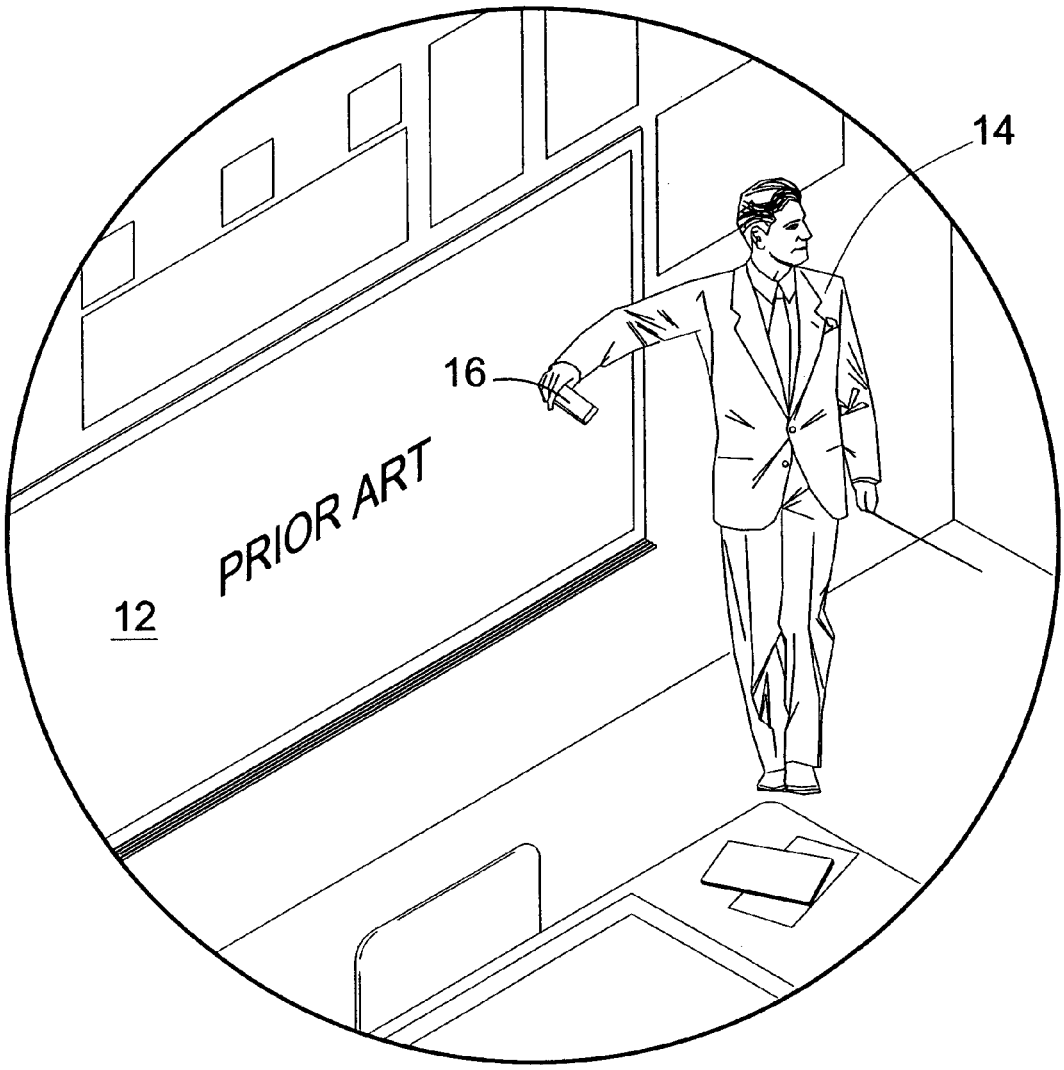
FIG. 1 PRIOR ART
FIG. 1 is an illustrative view of prior art.

With regard to reference numerals used, the following numbering is used throughout the drawings.

10 present invention
12 prior art chalk board
14 teacher/user
16 eraser
18 rail
20 sponge
22 reservoir
24 handle
26 pump
27 wheel
28 channel
30 support bracket
32 end cap
34 fill cap
36 chalk holder
38 spray nozzles
40 spring
42 clip
44 adjustable bracket
46 pin
48 pump activator member
50 reservoir bracket
52 alternate embodiment
54 water
56 means for a chalkboard cleaning member
58 outer sleeve
60 inner sleeve

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the prior art. The cleaning of a prior art chalk board 12 is a dusty and dirty task for many teachers 14. When using a common and universal chalk board eraser 16, chalk smears and leaves behind a chalk film that requires the application of water which in return creates a runny mess and promotes bacterial growth within the eraser. This method of cleaning a black board 12 can be a thing of the past. The present invention overcomes the short comings of prior art by providing a new and unique method of cleaning a chalk board of chalk markings with an apparatus that extends the height of a chalk board, is mounted on a rail and designed to travel along the rail for the cleaning of the chalk board in a single and complete sweep.

Figure 2:
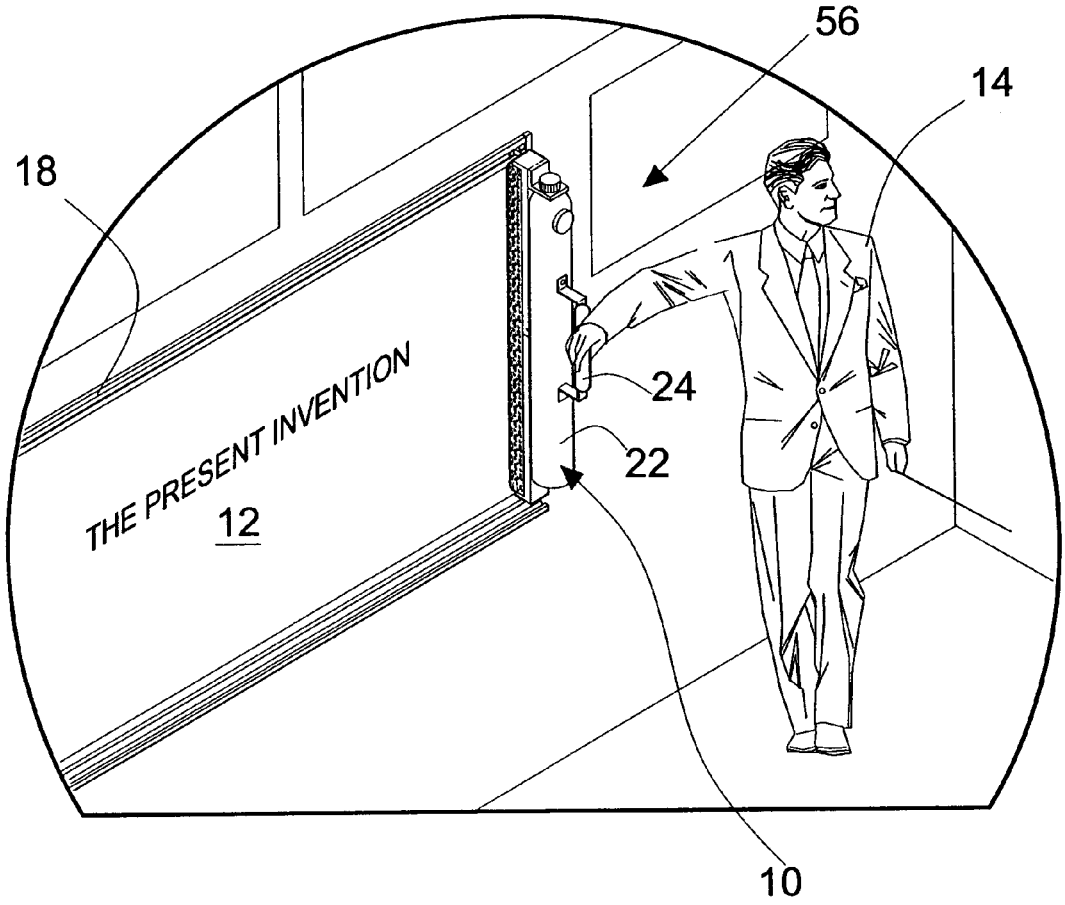
FIG. 2 is an illustrative view of the chalk board cleaning device of the present invention.

Turning to FIG. 2, shown therein is an illustrative view of the chalk board cleaning device of the present invention 10. The present invention 10 discloses an advanced chalk board cleaning system which comprises a rail 18 that is mounted to the top periphery or edge of a conventional chalk board 12 providing means for a chalkboard cleaning member 56 for the mounting and motion of a sponge 20 apparatus having a wheel that is placed within the rail channel and capped off by an end cap. The sponge 20 apparatus is drawn across the chalk board 12 riding on the wheel and within the rail channel 18, releasing a spray of water selectively placed by the user 14 by means of a pump system within a refillable reservoir 22. A handle 24 makes the movement of the device 10 simple and easy. The support bracket is adjustable for different size boards 12. A pressure spring allows the device 10 to move the sponge 20 apparatus away from the board 12 so that selective repositioning and cleaning of parts of the board are possible.

Figure 3:
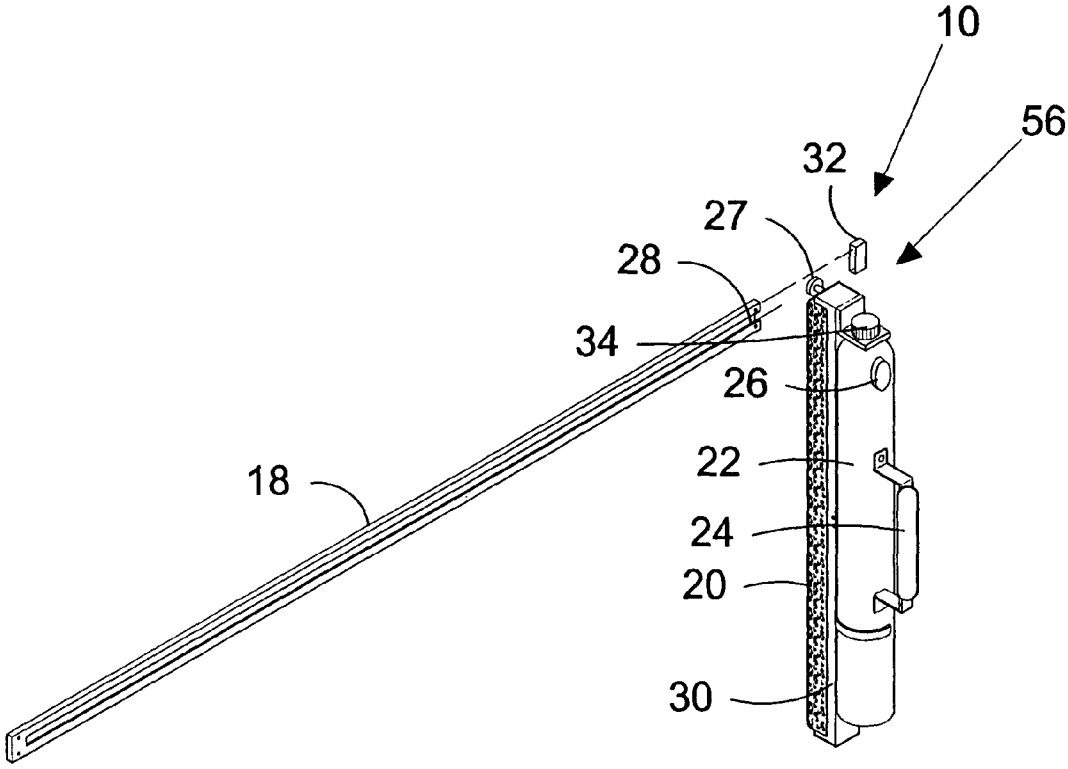
FIG. 3 is an exploded view of the chalk board cleaning device of the present invention.

Turning to FIG. 3, shown therein is an exploded view of the chalk board cleaning device of the present invention 10. Shown is the chalk board cleaning apparatus of the present invention 10 comprising a channeled 28 rail 18 for receiving the support bracket wheel 27 designed to ride the rail across a chalk board within the rail channel 28 having an end cap 32 thereon, pulling the sponge element 20 along the face of a chalk board cleaning away unwanted chalk markings. A fluid reservoir 22 with fill cap 34 and pump 26 provide the user with a selectively placed water spray into the interior of the sponge 20 to assist in the cleaning process. A handle 24 provides easy maneuvering of the device 10. The device 10 may be moved away from the board allowing the sponge 20 apparatus to be selectively repositioned for the cleaning of selected parts of the board. The support bracket 30 is adjustable to fit various size chalk boards. Means for a chalkboard cleaning member is shown at 56.

Figure 4:
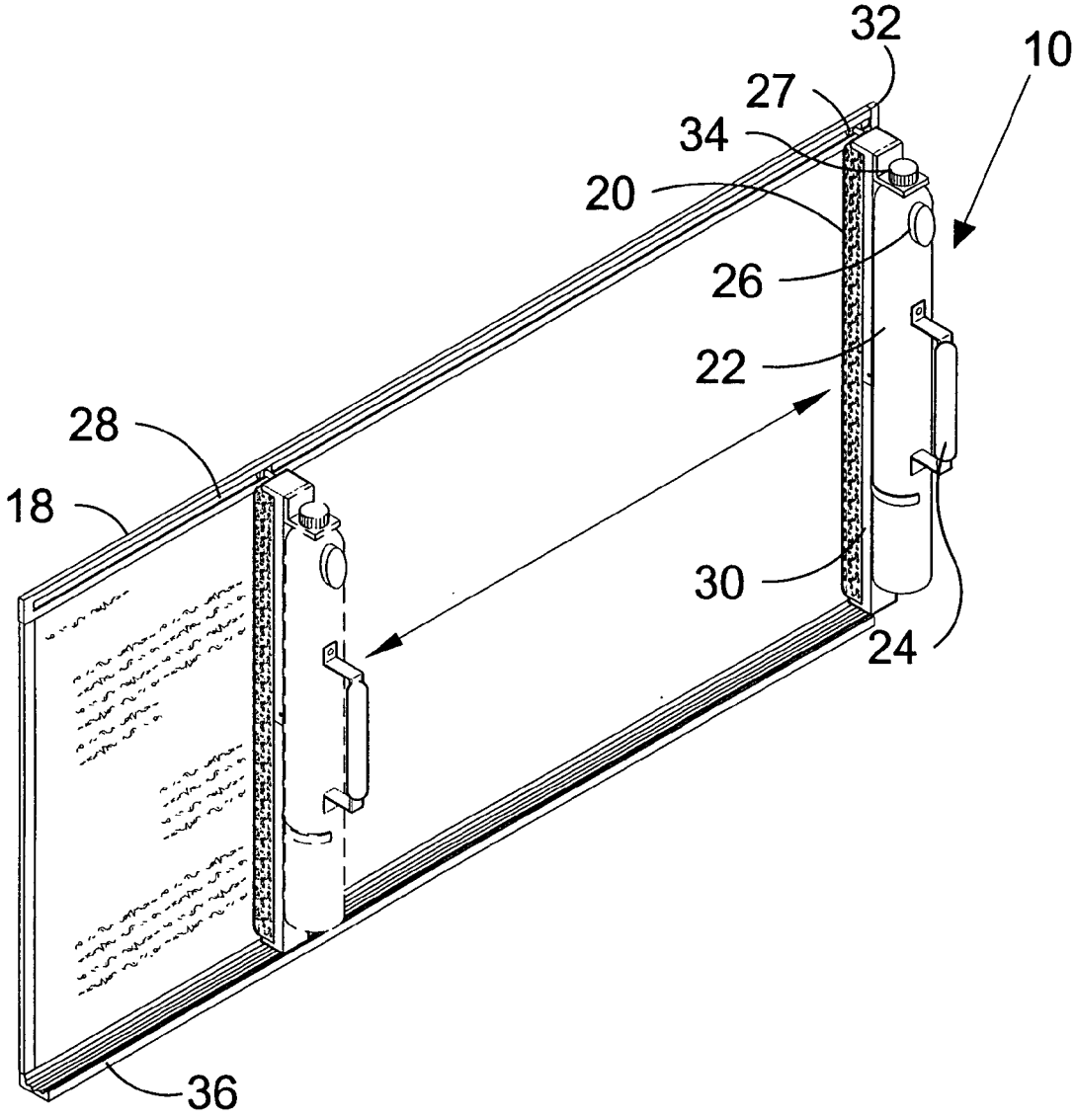
FIG. 4 is a perspective view of the chalk board cleaning device of the present invention.

Turning to FIG. 4, shown therein is a perspective view of the chalk board cleaning device of the present invention 10. Shown is the chalk board cleaning apparatus 10 in use. The user selectively depresses the pump 26 until the desired amount of water is dispensed and moves the apparatus 10 across the board until the desired cleaning procedure is completed. The cleaning apparatus 10 can be dismounted from the rail 18 to periodically clean the accumulated chalk dust from the board. A chalk holder 36 is shown along with other previously disclosed elements.

Figure 5:
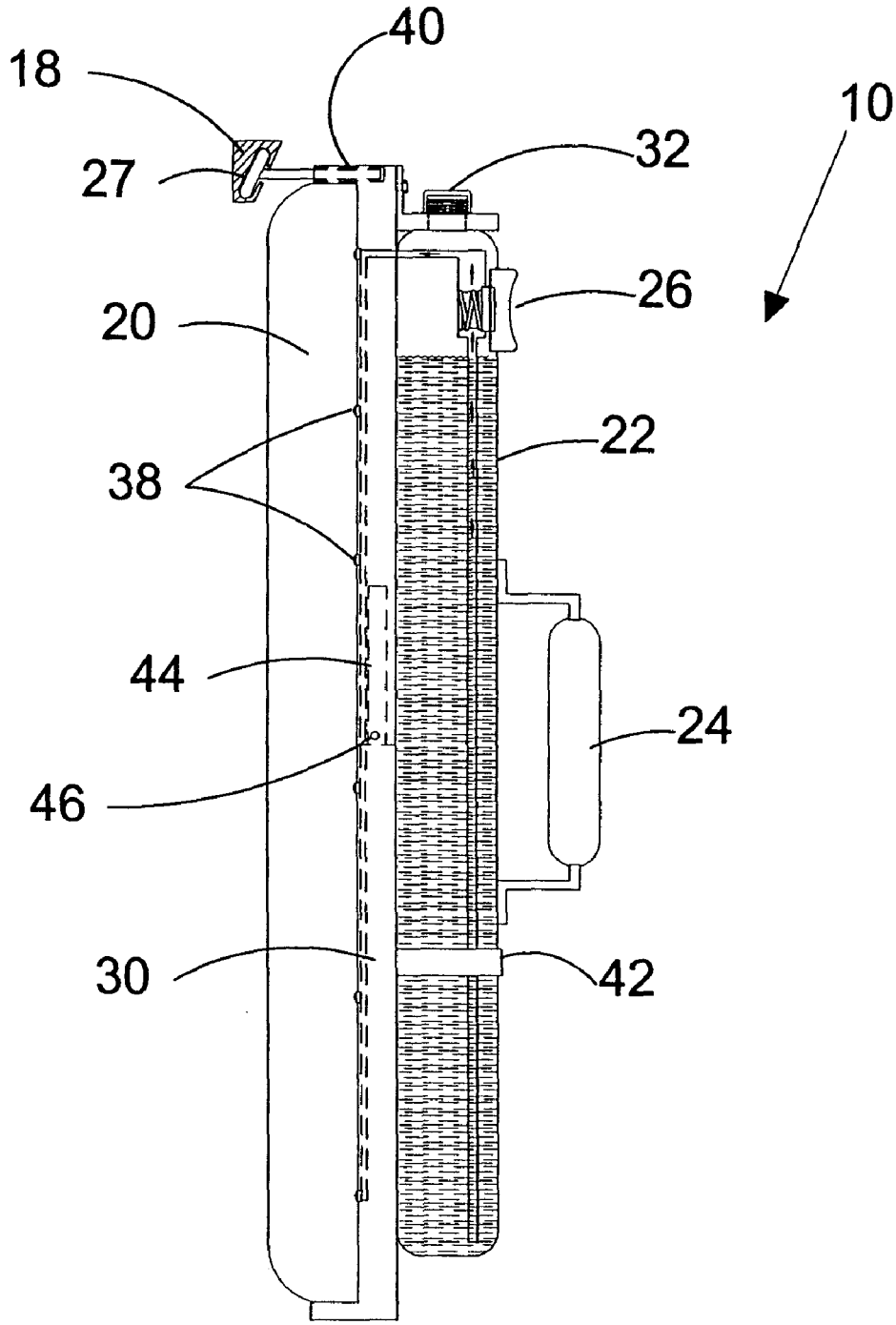
FIG. 5 is a sectional view of the chalk board cleaning device of the present invention.

Turning to FIG. 5, shown therein is a sectional view of the chalk board cleaning device of the present invention 10. Shown is the chalk cleaning apparatus of the present invention 10. A fluid reservoir 22 and manual pump 26 provide the user with a selective water spray from spray nozzles 38 which are disposed on the bottom side of bracket 30 to assist in the cleaning process. The manual pump 26 is depressed causing the fluid to travel to the spray nozzles 38 and into the sponge 20 providing additional cleaning power. Also shown are a spring 40 on an extendable retratable shaft being positioned in the out position, a clip 42, and an adjustable bracket 44 and pin 46. Wheel 27 is mounted onto a shaft which is perpendicular to the bracket 30 and which shaft is extendably retractable. Other elements previously disclosed are also shown.

Figure 6:
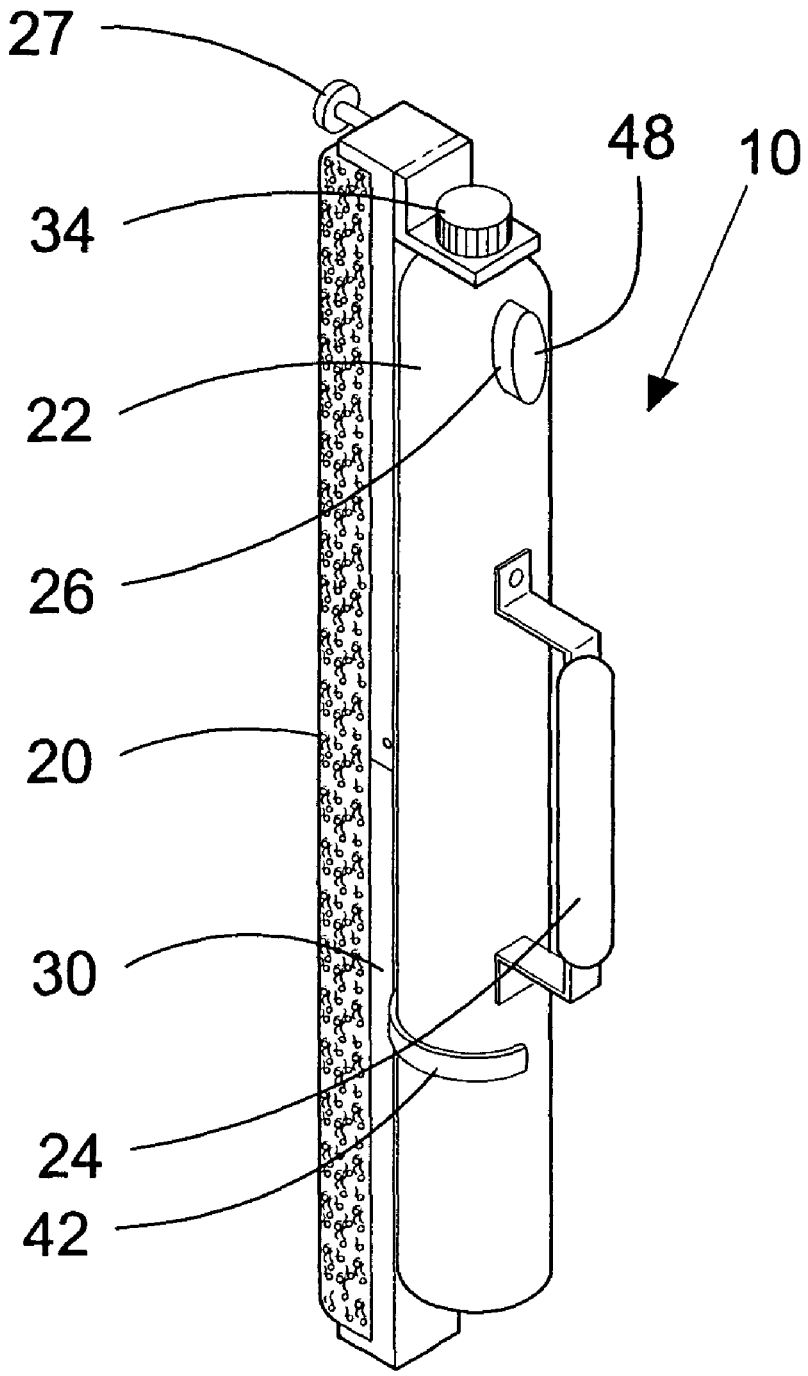
FIG. 6 is a perspective view of the chalk board cleaning device of the present invention.

Turning to FIG. 6, shown therein is a perspective view of the chalk board cleaning device of the present invention 10. Shown is the chalk cleaning apparatus of the present invention 10 comprising an adjustable support bracket 30 for mounting a sponge 20 therein. A wheel 27 designed to ride within the rail channel and tank 22 support elements are also shown. Also shown are a refillable tank 22 having a pump 26 therein and an external pump activation member 48 for dispensing water into the sponge 20 and a handle 24 mounted thereon that is used to move the device 10 across the chalk board and additionally can be used to carry the tank for refilling. Also shown are a fill cap 34 and clip 42.

Figure 7:
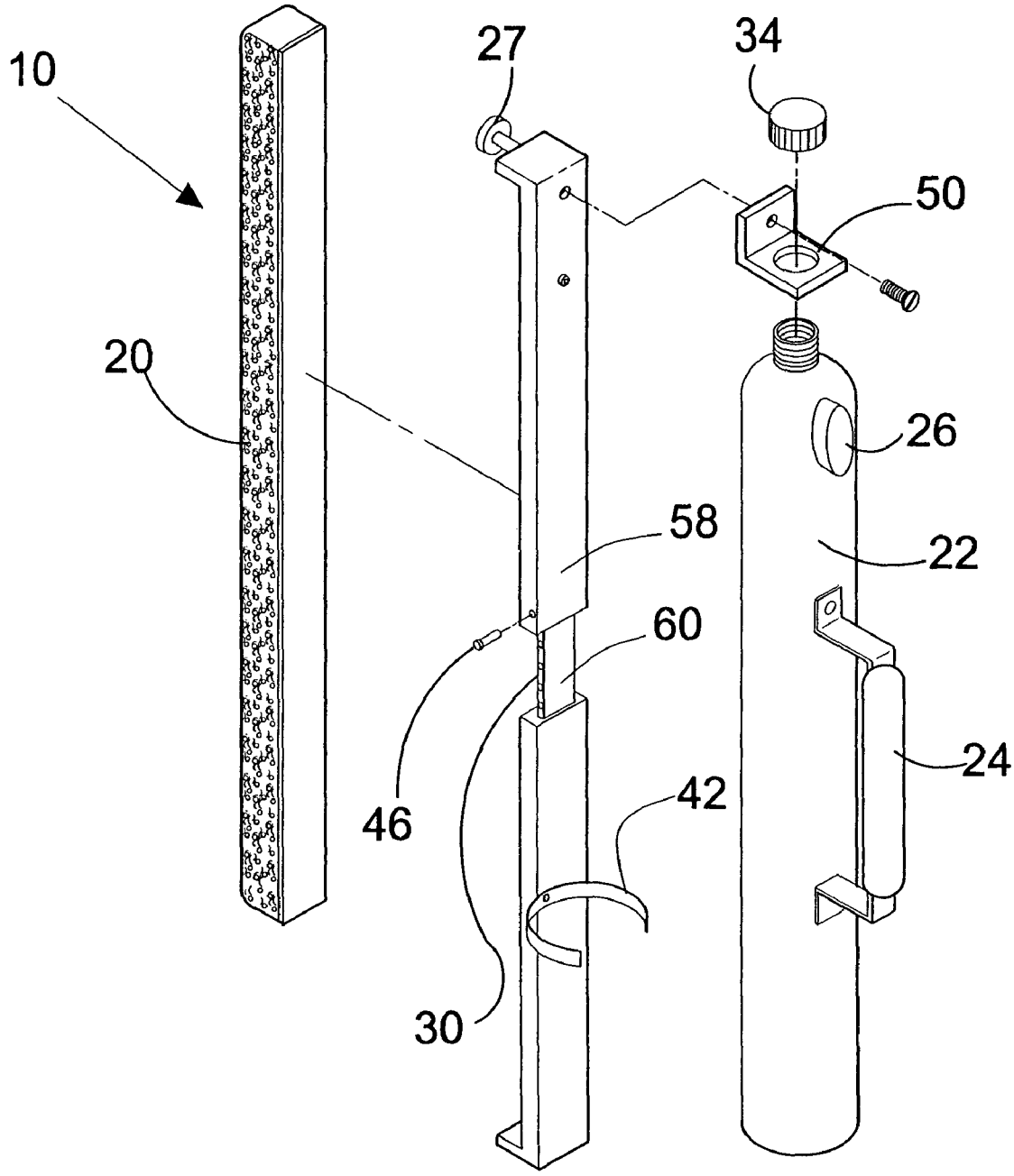
FIG. 7 is an exploded view of the chalk board cleaning device of the present invention.

Turning to FIG. 7, shown therein is an exploded view of the chalk board cleaning device of the present invention 10. Shown is the chalk cleaning apparatus of the present invention 10. A fluid reservoir 22 and manual pump 26 provide the user with a selective water spray to assist in the cleaning process. The manual pump 26 is pressed inward to activate the fluid to travel to the spray nozzles and into the sponge 20 providing additional cleaning power. A handle 24 provides easy maneuvering of the device 10. The sponge 20 will be a standard size of 55 inches by 5 inches by 1½ inch thickness and will be cut to the size of each board by the owner. A reservoir bracket 50 attaches reservoir 22 to support bracket 30 using a fastener, and, a semi-circular clip 42 which partially surrounds reservoir 22 is also used for attachment. Support bracket 30 comprises an outer sleeve portion 58 having an aperture therein and an inner sleeve portion 60 having a plurality of spaced apart apertures therein, wherein the inner sleeve telescopes within the outer sleeve to permit the length of the support bracket to be varied, along with a pin 46 which is inserted through the aperture of the outer sleeve into one of the co-aligned the plurality of apertures of the inner sleeve so as to secure the inner sleeve to the outer sleeve to permit the support bracket to be secured in a selected position. Other elements previously disclosed are also shown.

Figure 8:
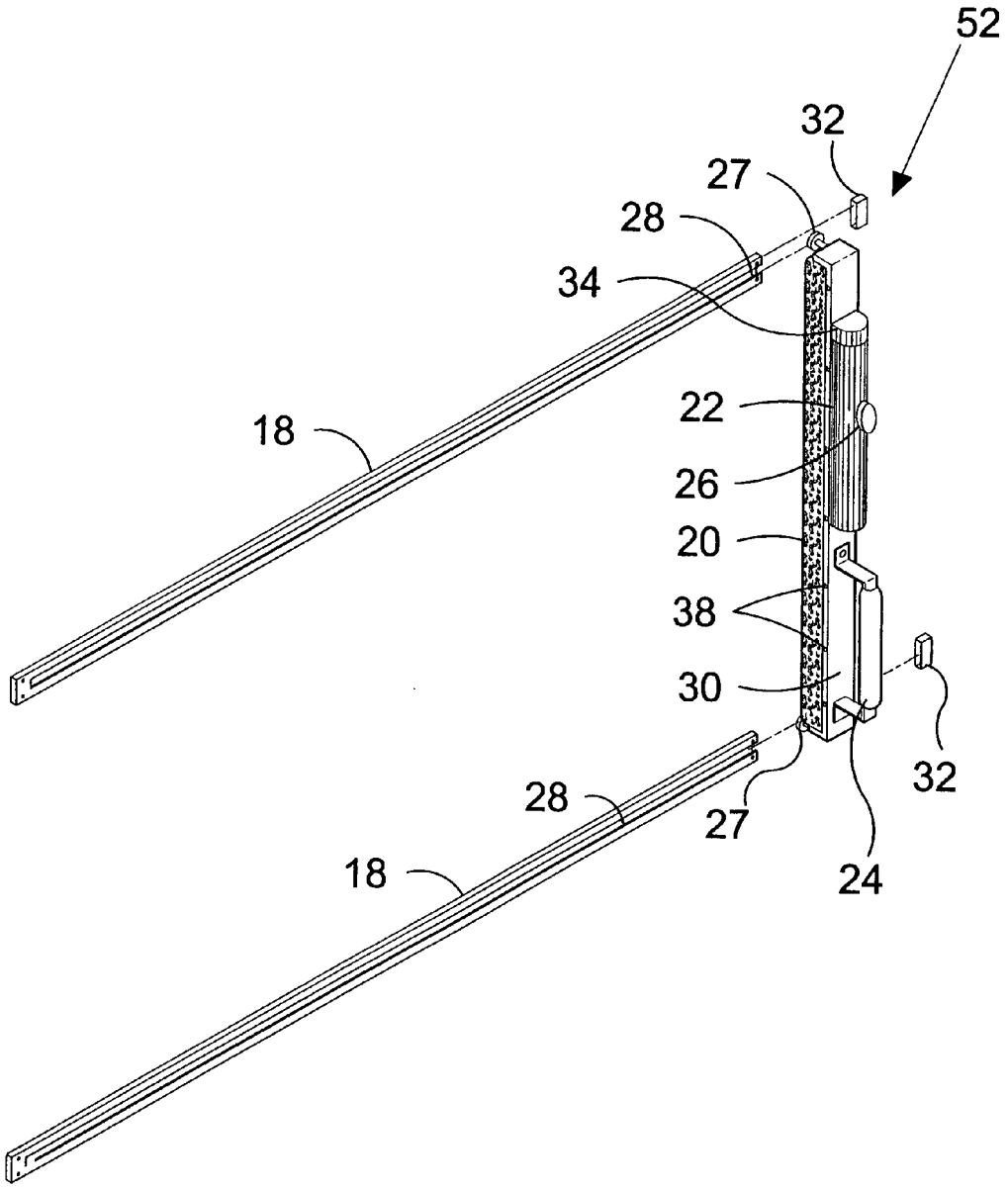
FIG. 8 is an exploded view of an alternate chalk board cleaning device of the present invention.

Turning to FIG. 8, shown therein is an exploded view of an alternate chalk board cleaning device 52 of the present invention. Shown is an alternate chalk board cleaning apparatus of the present invention comprising two channeled 28 rails 18 for the receiving of the support bracket wheels 27 designed to ride the rail 18 across the chalk board within the rail channels 28, pulling the sponge element 20 along the face of the chalk board cleaning away unwanted chalk markings. A fluid reservoir 22 and pump 26 provide the user with a selectively placed water spray from nozzles 38 to assist in the cleaning process. A handle 24 provides easy maneuvering of the device. Other elements previously disclosed are also shown.

Figure 9:
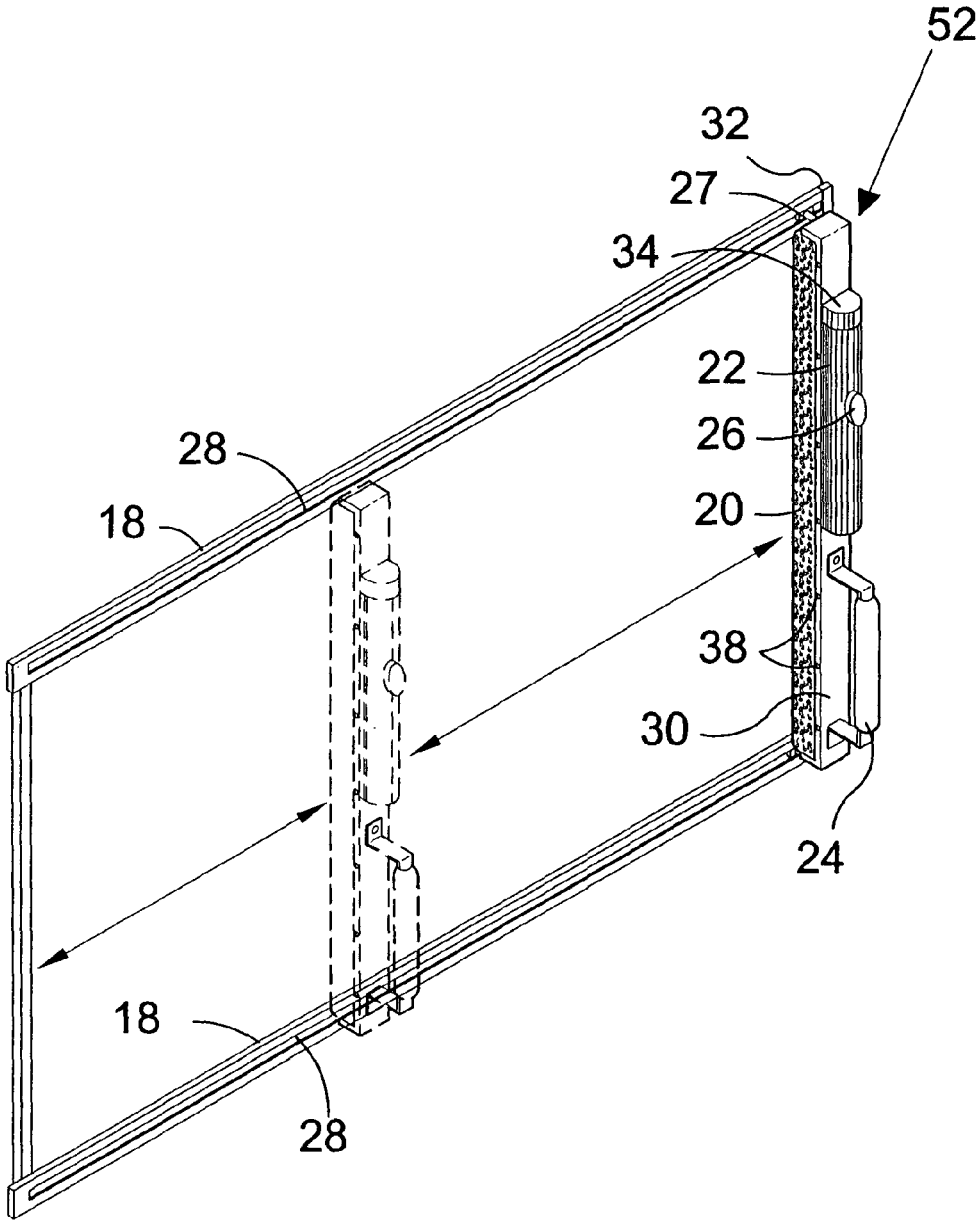
FIG. 9 is a perspective view of the alternate chalk board cleaning device of the present invention.

Turning to FIG. 9, shown therein is a perspective view of the alternate chalk board cleaning device 52 of the present invention. Shown is the alternate chalk board cleaning apparatus 52 in use. The user selectively depresses the pump 26 until the desired amount of water is dispensed and moves the apparatus 52 across the board until the desired cleaning procedure is completed. As shown, the cleaning apparatus 52 can be dismounted from the rails 18 to periodically clean the accumulated chalk dust from the board. Additionally the small quantity of water dispensed will prevent the sponge 20 from becoming saturated which will reduce the drying time and prevent mold and bacterial growth from forming on the sponge. Other elements previously disclosed are also shown.

Figure 10:
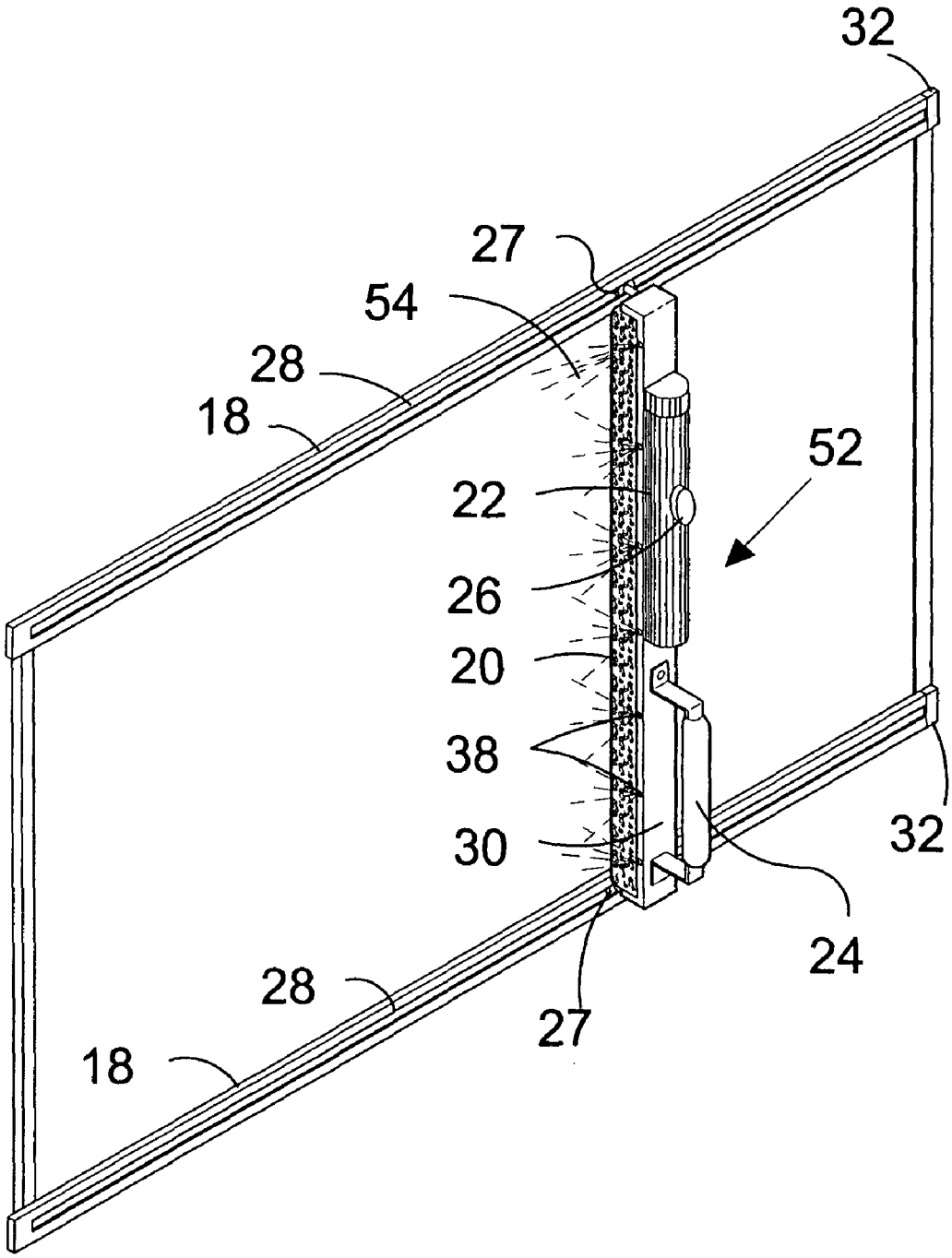
FIG. 10 is a perspective view of the alternate chalk board cleaning device of the present invention.

Turning to FIG. 10, shown therein is a perspective view of the alternate chalk board cleaning device 52 of the present invention. Shown is the alternate chalk board cleaning apparatus 52 being used to clean a chalk board and a quantity of water spray 54 being applied from a plurality of spray nozzles 38 which are mounted onto the front edge of bracket 30 adjacent the sponge. The amount of water 54 being dispensed is under the control of the user and can be dispensed at any point during the cleaning process with the need being determined by the user. An additional element of the present invention 52 can include means for moving the sponge 20 apparatus away from the board so that selective repositioning and cleaning of parts of the board are possible, such as when an instructor divides the board into sections. A section is normally defined as a vertical space where writing occurs comfortably without having to walk back and forth for each line. A positionable cleaning apparatus would allow selective cleaning of parts of the board. Other elements previously disclosed are also shown.

What is claimed to be new and desired to be protected by Letters Patent is set forth in the appended claims.

I claim:

1. An apparatus for cleaning a chalkboard, wherein the chalkboard is substantially upright standing, said chalkboard having first and second opposing ends, and top and bottom opposing edges, said apparatus comprising;

a) a rail disposed on said top edge of said chalkboard, said rail extending from said first end to said second end of said chalkboard, said rail having a channel therein, said rail having end caps on said first and second ends thereof; and, b) a chalkboard cleaning member being removably disposed on said rail whereby the chalkboard cleaning member cleans the chalkboard while moving along the rail from the first end to the second end of the chalkboard, wherein said chalkboard cleaning member comprises;

i) a support bracket having upper and lower opposing ends, a front and rear edge, and a top and bottom side wherein said bottom side is oriented toward said chalkboard;

ii) a wheel being disposed on said upper end of said support bracket, wherein said wheel is inserted into said channel of said rail to permit the support bracket to move along the rail from the first end to the second end of the chalkboard;

iii) a reservoir containing fluid being removably disposed on said top side of said support bracket, said reservoir having upper and lower ends;

iv) a sponge being fixed on said bottom side of said support bracket to permit the sponge to make contact with the chalkboard so that the sponge can clean the chalkboard, said sponge extending from said upper to the lower end of said support bracket;

v) a plurality of spray nozzles being disposed on said bottom side of said support bracket in a spaced apart manner, wherein fluid from said spray nozzles are directed toward said sponge to permit the chalkboard to be cleaned;

vi) a pump being disposed on said reservoir for pumping fluid from said reservoir to said spray nozzles to permit fluid from the reservoir to be sprayed into the sponge; and vii) a handle being disposed on said reservoir to permit a user to grasp the handle and thereby move the support bracket.

2. The apparatus of claim 1, wherein said support bracket is adjustable in length to permit it to fit various sizes of chalkboards.

3. The apparatus of claim 2, wherein said support bracket comprises an outer sleeve portion having an aperture therein and an inner sleeve portion having a plurality of spaced apart apertures therein, wherein said inner sleeve telescopes within said outer sleeve to permit the length of the support bracket to be varied, further comprising a pin which is inserted through said aperture of said outer sleeve into one of the co-aligned said plurality of apertures of said inner sleeve so as to secure said inner sleeve to said outer sleeve to permit the support bracket to be secured in a selected position.

4. The apparatus of claim 3, wherein said wheel rotates on a shaft, said shaft being disposed on said bottom side of said upper end of said support bracket, wherein said shaft is mounted perpendicular to said support bracket to permit the support bracket to move along the rail from the first end to the second end of the chalkboard.

5. The apparatus of claim 4, wherein said shaft of said wheel is extendably retractable along its longitudinal length to permit the support bracket to be moved away from the chalkboard so that the support bracket can be repositioned.

6. The apparatus of claim 5, wherein said shaft of said wheel is spring loaded to permit the shaft to be extendably retractable along its longitudinal length.

7. The apparatus of claim 6, wherein said pump is manually operated, further comprising a pump actuator button being disposed on said reservoir to permit a user to operate the pump.

8. The apparatus of claim 7, further comprising a fill cap being disposed on said reservoir to permit fluid to be placed in the reservoir.

9. The apparatus of claim 8, wherein said fill cap is disposed on said upper end of said reservoir further comprising a reservoir bracket for attaching said upper end of said reservoir to said support bracket.

10. The apparatus of claim 9, further comprising a semicircular clip disposed on said top side of said support bracket, wherein said clip partially surrounds said lower end of said reservoir to permit the reservoir to be secured onto the support bracket.

11. The apparatus of claim 10, wherein said sponge is about 55 inches in length to permit use with a standard chalkboard.

12. The apparatus of claim 11, further comprising an additional rail being disposed on said chalkboard, wherein said additional rail is disposed on said bottom edge of said chalkboard.

13. The apparatus of claim 12, further comprising an additional wheel being disposed on said bottom end of said support bracket for insertion into said additional rail to permit the support bracket to move along the rail from the first end to the second end of the chalkboard.

* * * * *